US005275084A

United States Patent [19]

Ruger

[11] Patent Number: 5,275,084

[45] Date of Patent: Jan. 4, 1994

[54] REINFORCED SLIDE CONFIGURATION FOR AUTOMATIC PISTOL

[75] Inventor: William B. Ruger, Croydon, N.H.

[73] Assignee: Sturm, Ruger & Company, Inc., Southport, Conn.

[21] Appl. No.: 991,847

[22] Filed: Dec. 16, 1992

Related U.S. Application Data

[63] Continuation of Ser. No. 694,194, May 1, 1991, abandoned, which is a continuation-in-part of Ser. No. 580,739, Sep. 11, 1990, abandoned, which is a continuation of Ser. No. 205,717, Jun. 13, 1988, abandoned.

[51] Int. Cl.[5] ..... F41A 3/66

[52] U.S. Cl. ..... 89/196

[58] Field of Search ..... 89/160, 161, 162, 163, 89/164, 196, 184, 185, 186, 187.01

[56] References Cited

U.S. PATENT DOCUMENTS

| | | | |
|---|---|---|---|
| 4,048,901 | 9/1977 | Ghisoni | 89/197 |
| 4,162,586 | 7/1979 | Pachmayr | 42/74 |
| 4,173,169 | 11/1979 | Yates et al. | 89/163 |
| 4,409,882 | 10/1983 | Blackshaw et al. | 89/163 |

*Primary Examiner*—Stephen M. Johnson
*Attorney, Agent, or Firm*—Pennie & Edmonds

[57] ABSTRACT

Reinforcement elements are attached to the exterior surface of the slide of an automatic weapon to prevent cracking of the slide at its most vunerable locations.

8 Claims, 5 Drawing Sheets

REINFORCED SLIDE CONFIGURATION FOR AUTOMATIC PISTOL

This application is a continuation of U.S. application Ser. No. 07/694,194 filed May 1, 1991 now abandoned which is a continuation-in-part of U.S. application Ser. No. 07/580,739 filed Sep. 11, 1990 now abandoned which in turn is a continuation of U.S. application Ser. No. 07/205,717, filed Jun. 13, 1988 now abandoned, both entitled "Reinforced Slide Configuration For Automatic Pistol".

BACKGROUND OF THE INVENTION

Slides for automatic pistols have included sides of varying thicknesses to accomplish desired appearances and for structural or other reasons. Automatic pistols must have their slides manually retracted to chamber the first cartridge to be fired; and it is also necessary to manually retract the slide to unload a chambered cartridge. Pistol slides are therefore customarily equipped with grasping grooves for facilitating manual retraction.

The sides of some pistol slides have included cutout or notched areas for effecting the proper location of the slide to the barrel during firing of the cartridge, and unlocking of these parts during recoil to allow cycling of the slide to expend spent cartridge cases and to effect reloading. Reciprocating slides have included techniques for accepting pivoting locking mechanisms which alternately lock and unlock the barrel slide. Such mechanisms for locking and unlocking the barrel and slide have included recesses formed in the interior of the slide which recesses inherently weakened the structure of the slide.

Slide previously used or proposed which include these locking recesses at thin sections of the slide have not been found to be satisfactory for extended and demanding use.

SUMMARY OF THE INVENTION

Broadly, this invention comprises an automatic pistol slide reinforced at its central exterior portion through adding a configured thickness to the sides of a slide in selected areas. Preferably, the reinforced elements of the slide are sufficient in thickness to accommodate gripping serrations without weakening the strength of the reinforced slide sides.

It is a feature that the reinforcing of the slide sides can be integrally formed in the slide as cast, forged or otherwise fabricated.

BRIEF DESCRIPTION OF THE INVENTION

DESCRIPTION OF THE PREFERRED EMBODIMENT

Figure 1:
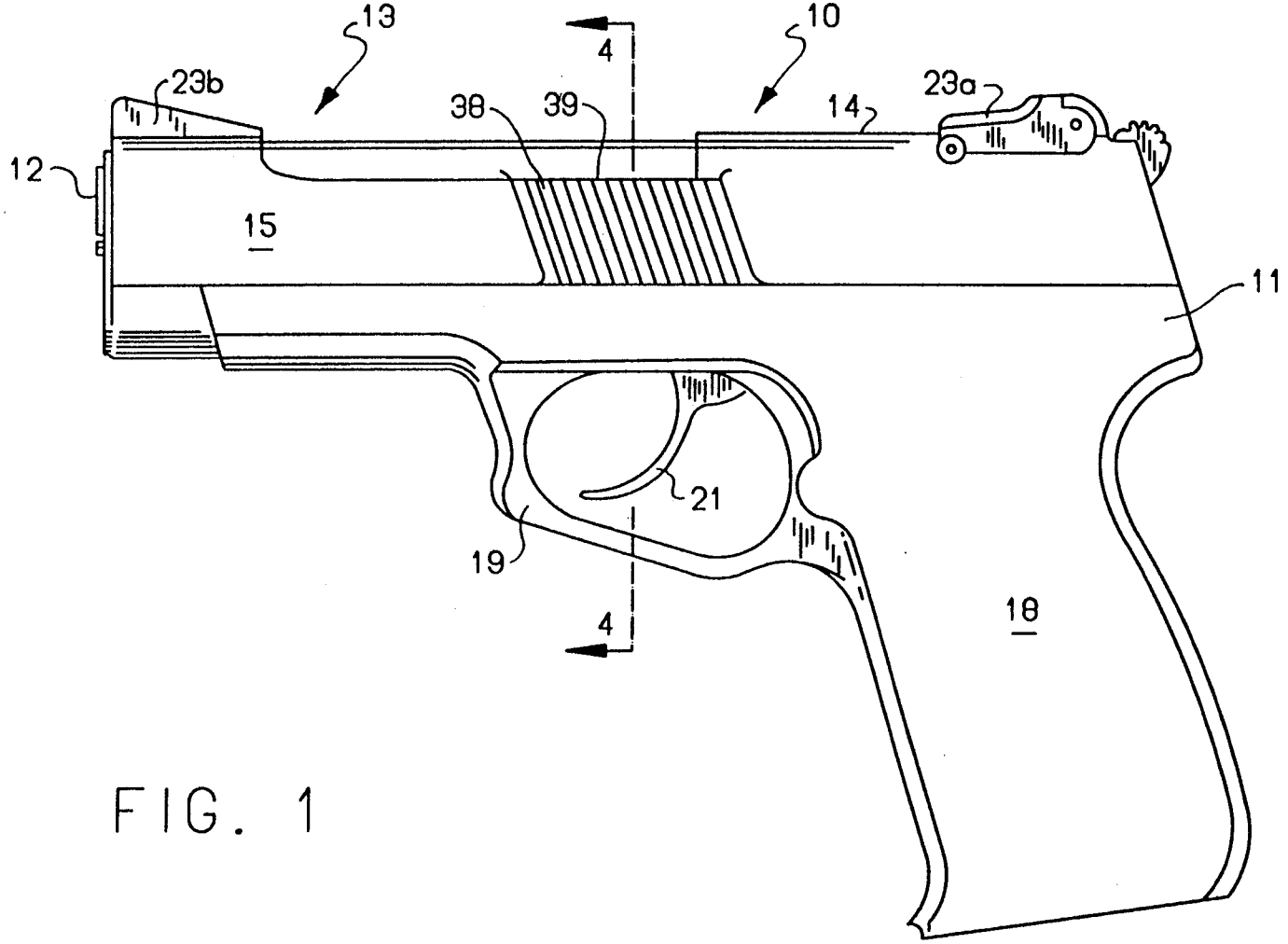
FIG. 1 is a side elevational view of an automatic pistol including the present invention.

In the figures, pistol 10 includes frame 11, barrel 12, slide 13 including upper slide portion 14, left side 15 and right side 17. Also shown are handle 18, trigger guard 19, trigger 21, hammer 22, and sights 23*a*, 23*b*. Sides 15, 17 include forward and rearward sections 15*a*, 15*b*, 17*a*, 17*b* and central portions 15*c*, 17*c* with less vertical depth than sections 15*a*, 15*b*, 17*a*, 17*b*.

Figure 2:
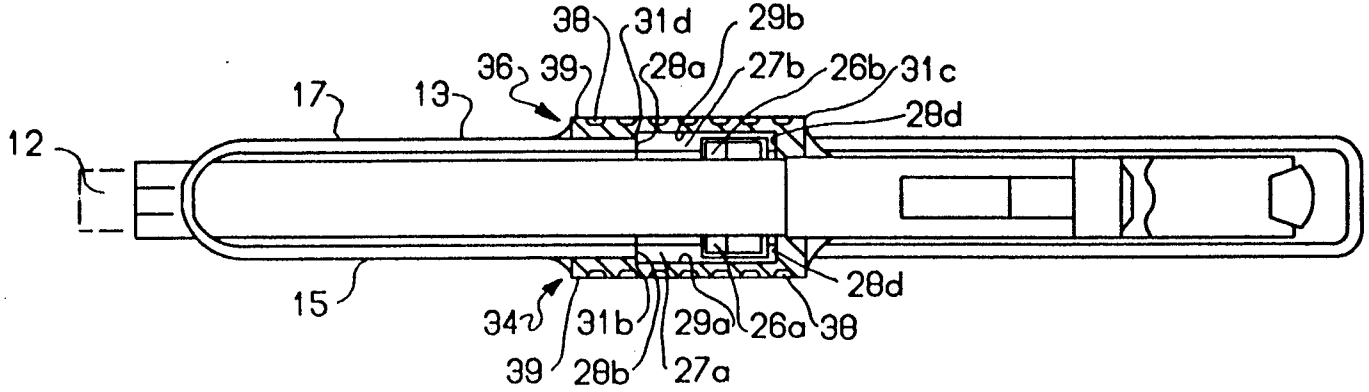
FIG. 2 is a plan view of the pistol.
Figure 4:
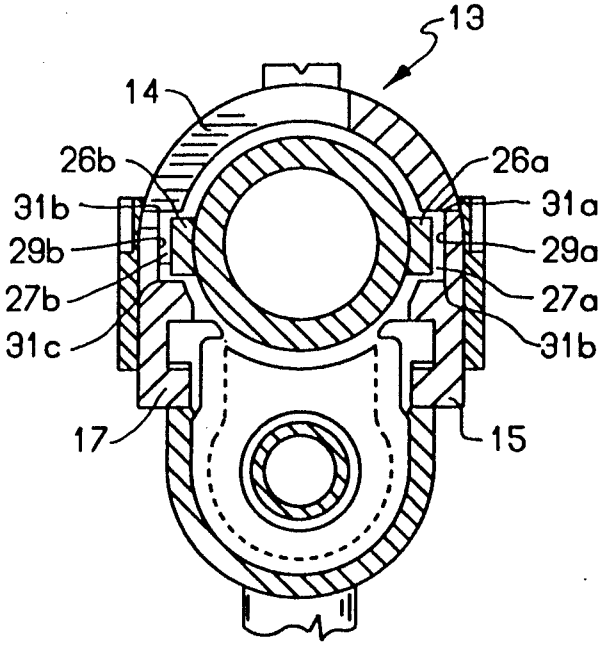
FIG. 4 is an enlarged sectional view along line 4—4 of FIG. 1.
Figure 3:
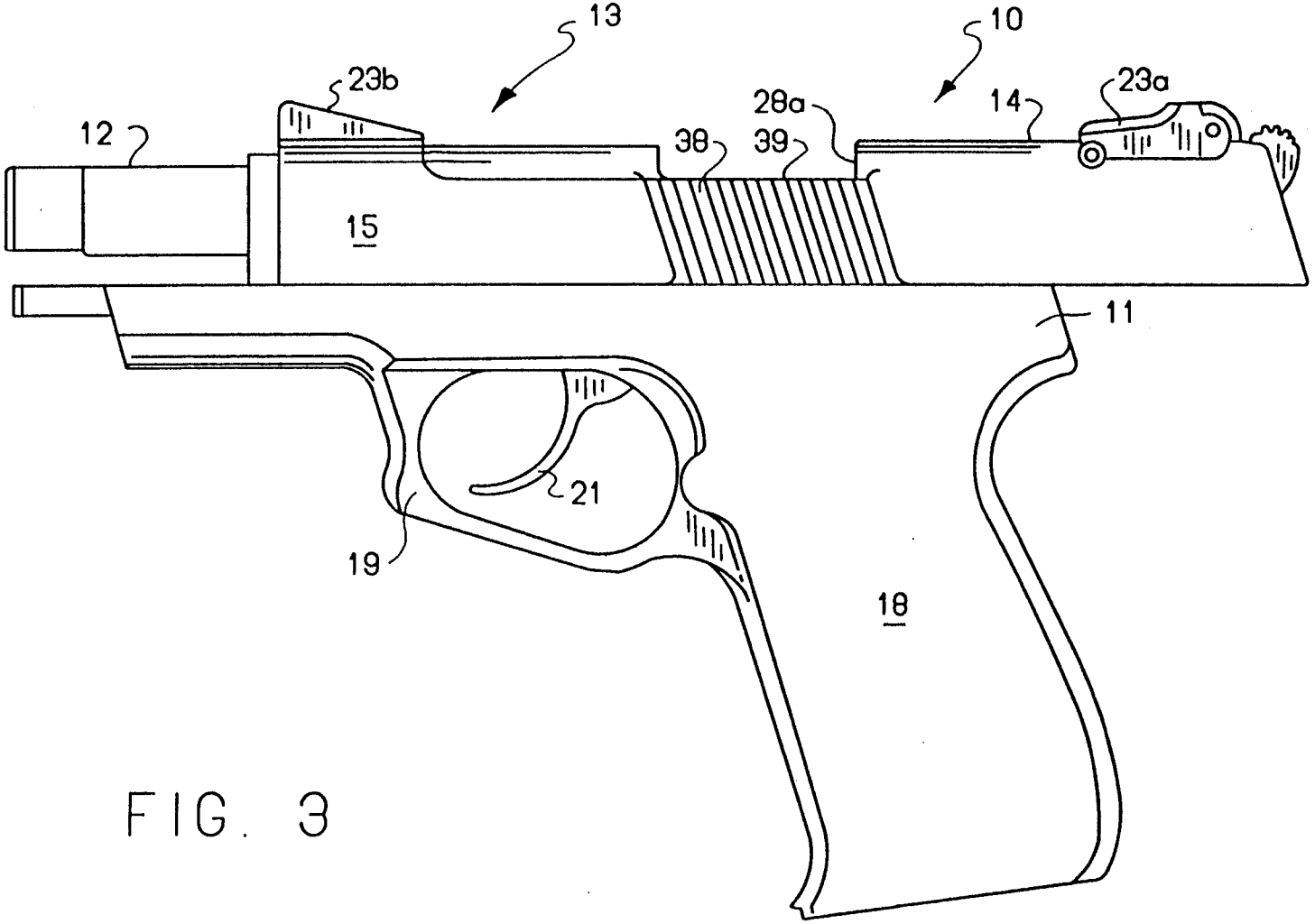
FIG. 3 is a side elevational view of the pistol with its slide retracted.

The pistol barrel-slide locking mechanism includes barrel locking lugs 26*a*, 26*b* mounted on the exterior of the barrel 12 which are, at firing, housed in configured recesses 27*a*, 27*b* in slide sides 15, 17, respectively. When slide 13 is in its forward firing locked position barrel lugs 26*a*, 26*b* operate in recesses 27*a*, 27*b* to lock barrel 12 and slide 13 together (FIG. 2). As the slide 13 retracts, lugs 26*a*, 26*b* rotate out of recesses 27*a*, 27*b* freeing slide 13 for further rearward movement to its fully retracted position. Recesses 27*a*, 27*b* are formed with vertical planar recess ends 28*a–d* and vertical planar recess wall 29*a*, 29*b* whose intersections form corners 31*a–d*.

Recesses 27*a*, 27*b* have a size such that the minimum thickness of the slide sides 15, 17 is about ⅛ inch or less. To reinforce slide 13 at and near each recess 27*a*, 27*b*, reinforcing raised slide side portions 34, 36 are located on the slide sides 15, 17 extending forward and rearwardly of the recesses 27*a*, 27*b* to provide sufficient thickness of material in the slide recess corner areas 31*a–d* and beyond to add to the strength in such areas and to reduce the likelihood of cracking or breaking of slide 13 after extending firing and cycling of the pistol barrel and slide.

Reinforcing portions 34, 36 preferably are about ⅛" thick, though their thickness, length and vertical depth may vary depending on the size of the internal slide recesses 27*a*, 27*b*. Reinforcing portions 34, 36 may be manufactured as an integral part of the slide or as separate pieces welded to slide 13 or otherwise attached. Reinforcing portions 34, 36 of about one-third the length of slide 13 are preferred but they may be longer or shorter.

Reinforcing portions 34, 36 carry grip indentations 38 and projections 39 forming angled grip serrations 40. Portion 34 or 36 may also be notched on its lower side for an external slide stop notch, if necessary.

Figure 5:
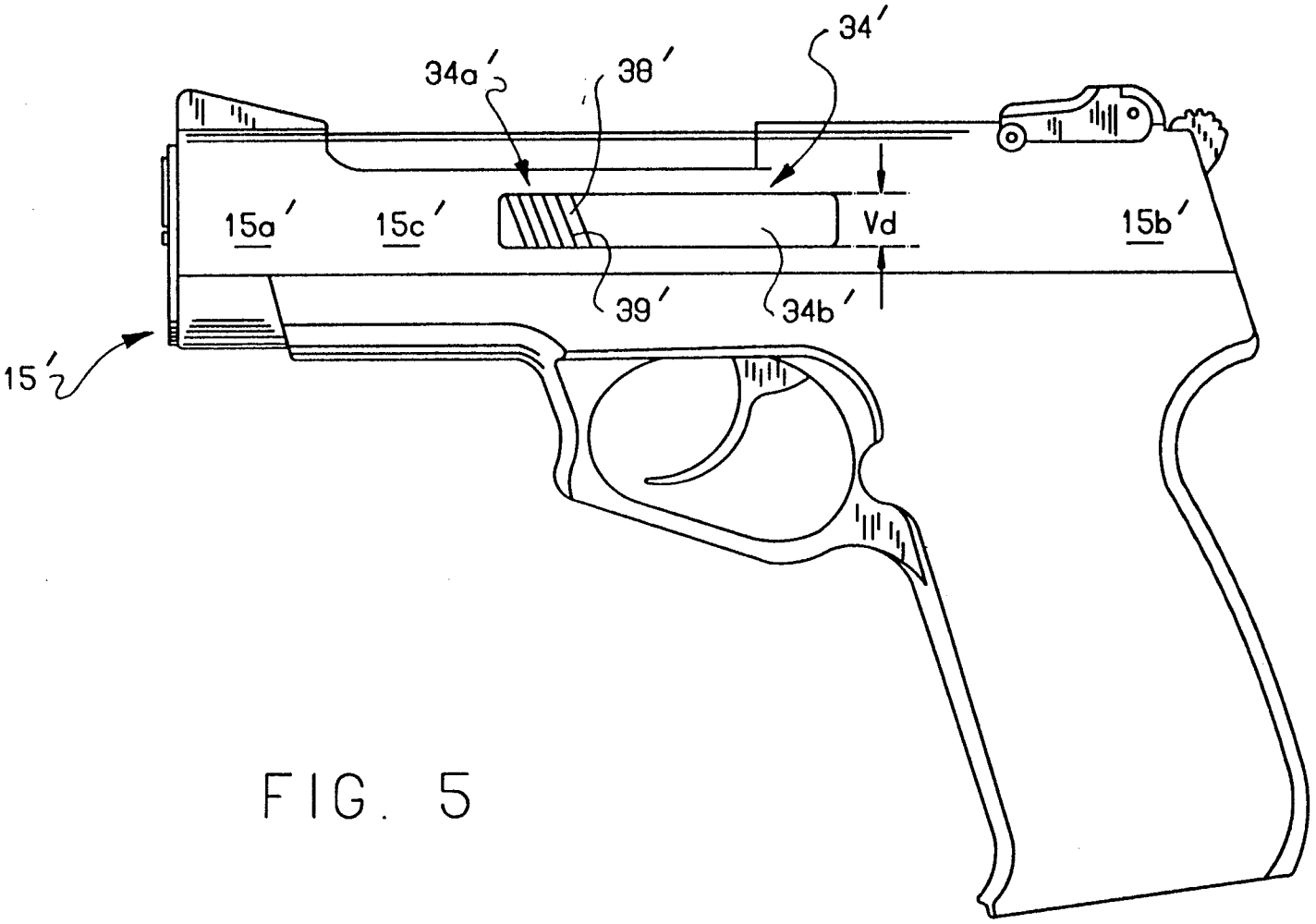
FIG. 5 is a side elevational view of an alternative embodiment of the invention.
Figure 6:
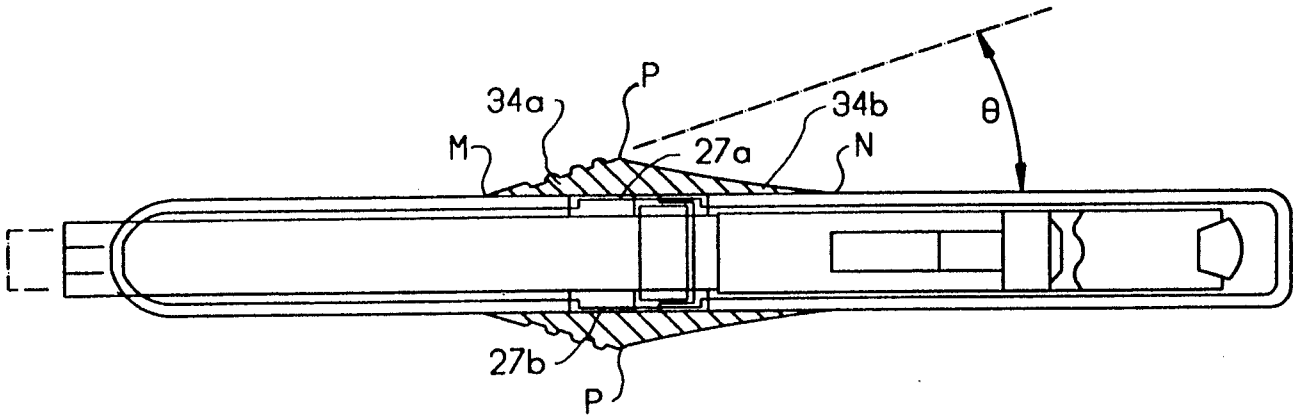
FIG. 6 is a plan view of the inventive alternative.

Finally turning to FIG. 5, an alternative embodiment is shown in which reinforcing portions 34', and 36' are different in size and shape. Portion 34' has a vertical depth (vd) which is less than the vertical depth of side section 15*c'*, includes forward portion 34*a'* with indentations 38' and projections 39' forming angled grip serrations 40'. Reinforcing portion 34' also has a rearward tapering non-grip portion 34*b'*. Forward portion 34*a'* is sloped at angle $\theta$ the barrel axis forming the front surface of serrated grip portion 34*a'* (FIG. 6). From the thickest point P of portion 34' rearward is trailing portion 34*b'*.

Recesses 27*a'*, 27*b'* are reinforced by portions 34', 36' to provide greater strength in the vicinity of recesses 27*a'*, 27*b'*. Reinforced portions 34', 36' are positioned vis-a-vis the recesses 27*a'*, 27*b'* they reinforce and do not need to extend to either end of slide 15' since such ends are distant from the recesses. Reinforcing portions 34', 36' are longer horizontally than recesses 27*a'*, 27*b'* respectively. Normally reinforcing portions 34', 36' extend from about ¼ to ⅓ the length of the slide but may be outside that range. Forward point M is in the range of one inch forward of recess 27*a'* and point N is the same magnitude of distance rearward of recess 27*a'*. Similarly, since recesses 27*a'*, 27*b'* have small vertical depths the reinforcing portions 34', 36' require vertical depths only of a magnitude to be greater than the recess depths for proper reinforcement. The vertical depth of portions 34', 36' maybe less than the central section 15*c'* of the side of the slide 15'.

I claim:

1. In an automatic pistol having a barrel, and a retractable slide which said slide has an upper portion and two sides each having a central side portion each of which said central side portion includes an internal locking area recess and an exterior surface and a locking mechanism engaging said internal locking area recess for locking the barrel with respect to the slide, the improvement comprising an external reinforcing element raised on the exterior surface of each said central side portion of said slide which said external reinforcing element extends a distance less than an entire length of the slide side and are positioned adjacent to the internal locking area recess in the said side to reinforce the central side portion including said internal locking area recess.

2. The improvement of claim 1 in which each said reinforcing element has an operator-hand gripping element formed in said external reinforcing element.

3. The improvement of claim 1 in which each said central side portion has a vertical depth and a selected length with each said reinforcing element extending vertically a portion of the vertical depth of the said side portion and extends horizontally about one-third of the length of the slide side.

4. In an automatic pistol having a barrel, and a retractable slide which said slide has an upper portion and two side portions each of which said side portions include an internal recess and an exterior surface and a locking mechanism for locking the barrel with respect to the slide, the improvement comprising an external reinforcing element including a forward portion with a sloping front surface having serrations and a tapering rearward portion, said reinforcing element raised on the exterior surface of the side portion of said slide which said external reinforcing element including the forward and rearward portions extends a distance less than an entire length of the slide side and is positioned adjacent to the internal recess in the side portion to reinforce the slide with the reinforcing element extending a substantial distance forward and a substantial distance rearward of the internal recess.

5. The improvement of claim 4 in which each said side portion has a reinforcing element.

6. The improvement of claim 4 in which each said reinforcing element has serrated operator-hand gripping element formed on said external reinforcing element.

7. The improvement of claim 4 in which each said side portion has a vertical depth and a selected length with each said reinforcing element extending vertically a portion of the vertical depth of the said side portion and extends horizontally about one-third of the length of the slide side.

8. The improvement of claim 4 in which said internal recess has a selected vertical depth and in which each said side portion has a vertical depth and a selected length with each said reinforcing element extending vertically a distance greater than the vertical depth of the internal recess and the reinforcing element extends horizontally a portion of the length of the slide side.

* * * * *